United States Patent [19]

Keeton

[11] Patent Number: 4,503,790

[45] Date of Patent: Mar. 12, 1985

[54] AUTOMATIC ELASTIC LOOP FORMING

[76] Inventor: John H. Keeton, P.O. Box 296, Campbellsville, Ky. 42718

[21] Appl. No.: 429,426

[22] Filed: Sep. 30, 1982

[51] Int. Cl.[3] ..... D05B 23/00

[52] U.S. Cl. ..... 112/121.27; 112/121.26; 112/262.2; 112/262.3

[58] Field of Search ..... 112/121.27, 121.26, 112/121.29, 63, 10, 305, 307, 262.2, 262.3, DIG. 2, DIG. 3

[56] References Cited

U.S. PATENT DOCUMENTS 3,448,707 6/1969 Thomsen ..... 112/121.26
3,777,683 12/1973 Lee .
3,780,679 12/1973 Hanes, Jr. et al. .
3,949,688 4/1976 Andersson ..... 112/121.26
4,366,764 1/1983 McCurry ..... 112/121.27

*Primary Examiner*—Ronald Feldbaum
*Attorney, Agent, or Firm*—Cushman, Darby & Cushman

[57] ABSTRACT

Elastic loops of predetermined length are formed utilizing an annular channel of fixed circumference, and having an interior overfeed opening. The length of elastic band fed to the channel is determined by a separate, readily adjustable mechanism, independent of the channel circumference. Air jets assist a feed roller in feeding the elastic, and air jets blow the formed elastic loop out of the channel after formation of it, and severing of it from the supply of elastic. Feed dogs move the formed loop ends out along an arm into contact with an automatic sewing machine.

26 Claims, 12 Drawing Figures

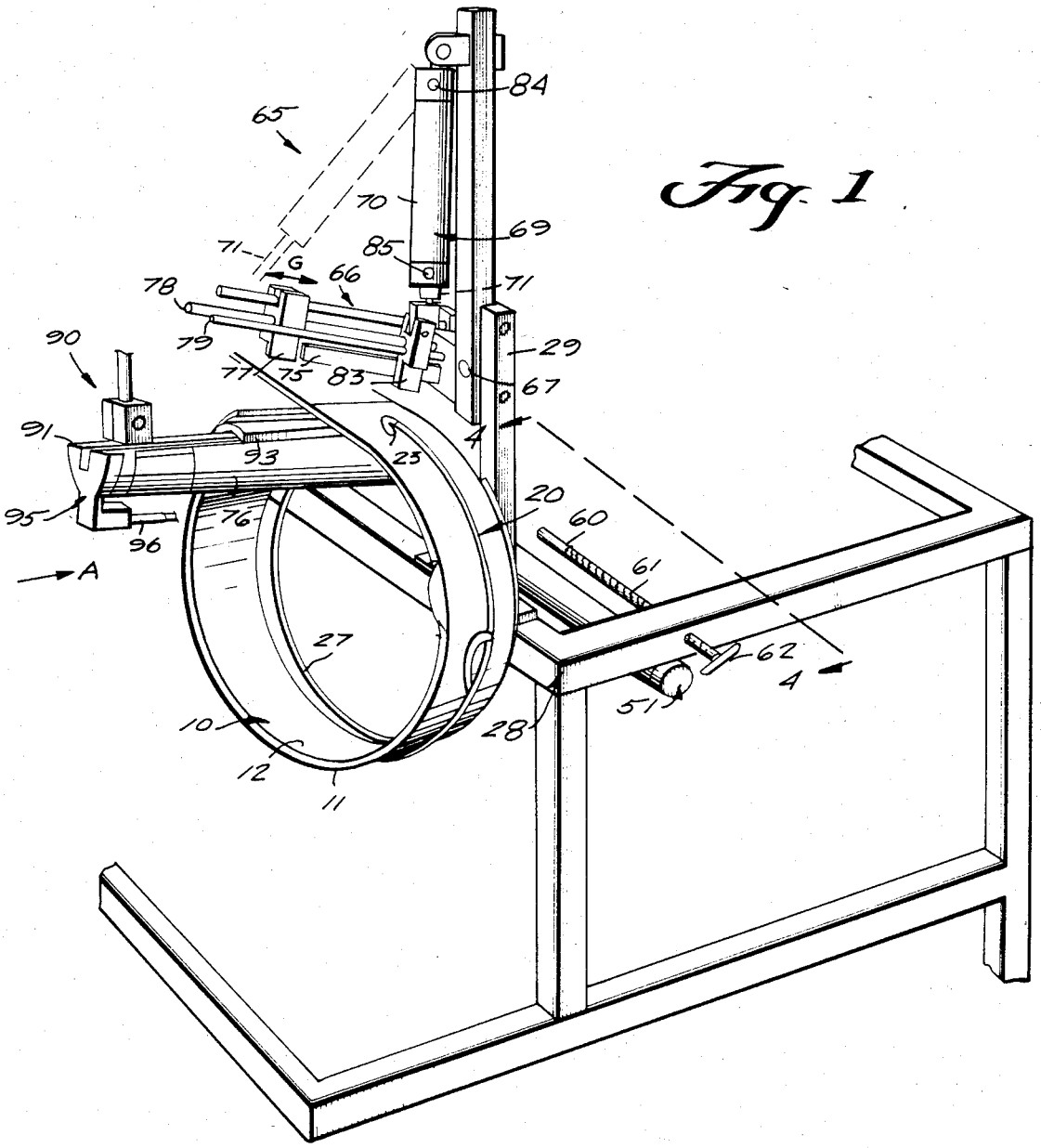
Fig. 1
Fig. 3
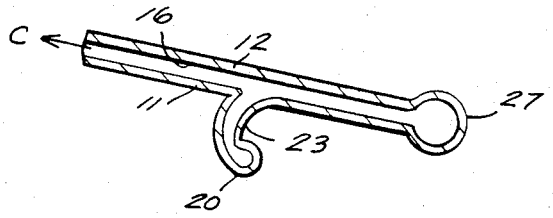

AUTOMATIC ELASTIC LOOP FORMING

BACKGROUND AND SUMMARY OF THE INVENTION

The automatic formation of elastic loops is necessary in many different areas of the garment industry. For instance in the making of men's and boy's underpants, it is necessary to form a wide variety of different sizes of elastic loops to be used as the waistband for such garments. Typical machines on the market are able to make about 10–12 loops per minute and require significant downtime to change over from one loop size to another. This downtime is necessary since different sizes of hoops into which the elastic loop is fed are often used to control the size of the elastic loop being formed.

According to the method and apparatus of the present invention, elastic loop formation may be practiced in a manner that is much quicker than conventional elastic loop formation. Utilizing the machine and practicing the method according to the present invention, it is possible to form about 40–60 loops per minute, and there is no substantial downtime when changing over from one size of loop to another.

The basic features of the present invention that allow it to accomplish its desirable results are the provision a loop length determining structure independent of the size of the hoop utilized to form the loop, meaning that only one hoop is necessary; utilizing particular air jets for feeding the elastic material into the hoop and expelling it from the hoop, and a particular construction of the hoop corresponding thereto; and the utilization of a particular cutting and feeding head.

It is the primary object of the present invention to provide a method and apparatus for the quick and efficient automatic formation of elastic loops. This and other objects of the invention will become clear from an inspection of the detailed description of the invention, and from the appended claims.

BRIEF DESCRIPTION OF THE DRAWINGS

FIG. 1 is a perspective view of exemplary apparatus for practicing the method according to the present invention;

FIG. 2 is a detail cross-sectional view taken along lines 3—3 of FIG. 2, and showing particular pneumatic components thereof;

DETAILED DESCRIPTION OF THE DRAWINGS

Figure 2:
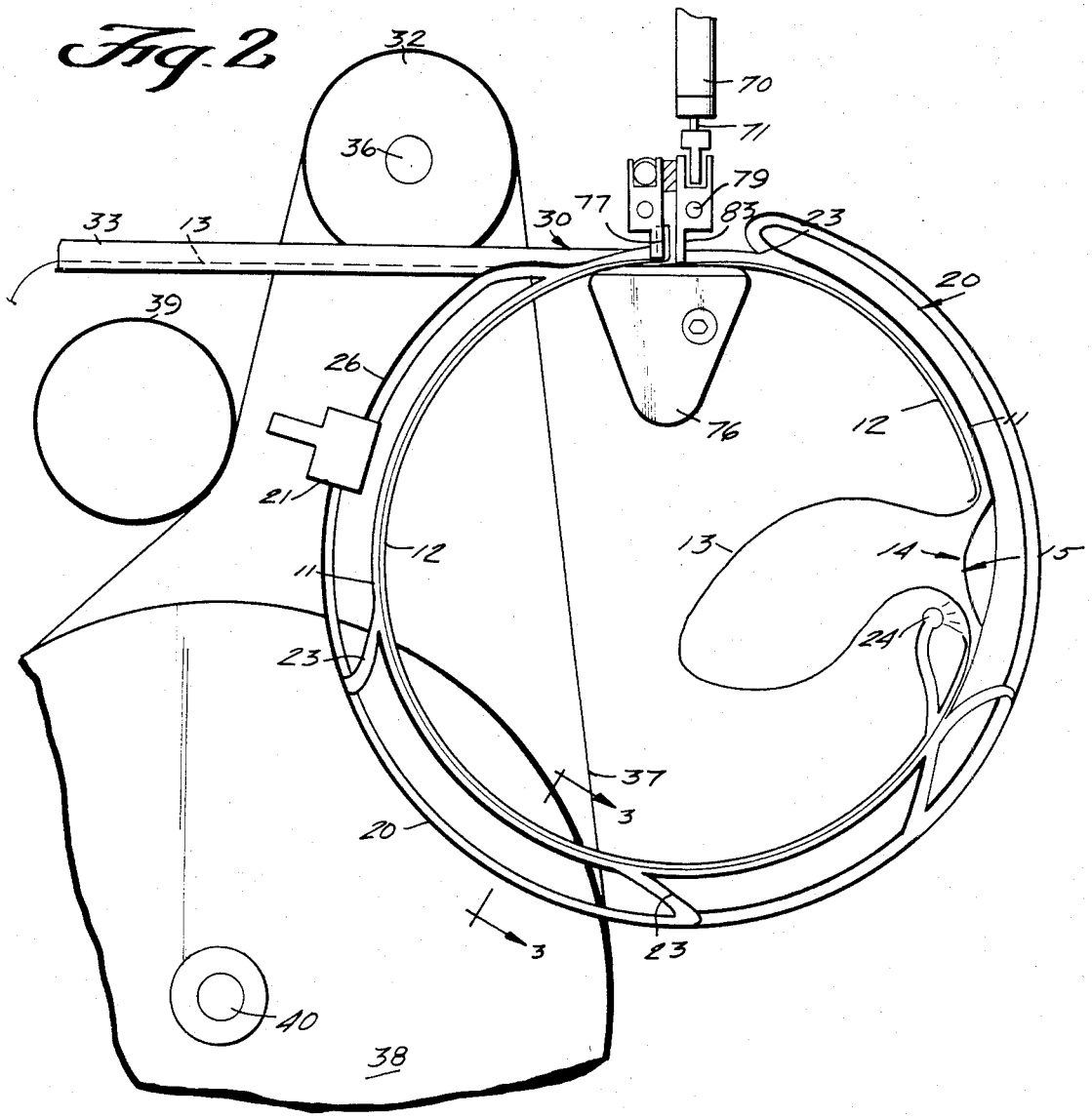
FIG. 2 is an end view of the apparatus of FIG. 1 looking in the direction of arrow A in FIG. 1.

One of the basic components of the apparatus according to the present invention is the looper or hoop down generally by reference numeral 10 in FIGS. 1 and 2.

The hoop includes an outer tubular shell 11, and an inner tubular shell 12 that are spaced from each other radially, and concentric. Between them they define an annular channel 16 through which an elastic strap 13 is adapted to be fed. At one part of the hoop 10 a radial, axially extending, opening 14 is provided, which allows the elastic band 13 to move radially inwardly at that point, the opening 14 being shown at the nine o'clock position in the exemplary embodiment illustrated in FIG. 2. Mounted on the inner face of the outer shell 11 of the hoop 10 at the opening 14 is the radially inwardly extending ramp projection 15, which allows elastic band overfeed through opening 14, as illustrated in FIG. 2.

Also associated with the hoop 10 is the pneumatic elastic band feed system, which includes the pneumatic tube 20 which substantially encircles the outer shell 11, and is supplied air from a pneumatic source 19 (FIG. 6) through connector 21 (see FIG. 2). At a number of positions along the circumference of the channel 16 between the shells 11, 12, air jet pipes 23 extend into the channel so that they force air into the channel in a clockwise direction, and thereby assist in movement of the elastic band through the channel. Adjacent the opening 14 and projection 15 another air jet 24 is provided, the air jet 24 being directed to cause the elastic band leading end—when it is first being fed through the channel—to go back into the channel 16 after it passes over the tip of the projection 15. The jet 24 does not, however, hinder formation of the elastic overfeed bulge illustrated in FIG. 2.

The pneumatic connection to the hoop 10 further comprises a conduit 26 in operative association with the connector 21, which extends to a header 27—see FIG. 3—on the side of the channel 16 between shells 11, 12 closest the mounting frame 28. The header 27 is substantially circumferentially continuous along the length of the channel 16, and is for selectively supplying air to the channel to blow the elastic loop out of the channel in direction C (see FIG. 3) after completion of a loop formation. The connector 21 preferably includes a valve which feeds air to either the conduit 20 or the conduit 26 depending upon the control thereof (e.g. see FIG. 6). The valve is preferably biased to a position allowing flow to conduit 20.

As illustrated in FIG. 1, a vertically extending bar 29 connected to frame 28 preferably mounts the hoop 10 so that it has a vertical orientation—i.e., its axis is horizontal.

The elastic band 13 is fed into the open top area 30 of the channel 16 defined by the shells 11, 12 by a feed roller 32, which engages the top surface of the band 13 while the bottom of the band 13 engages the bottom of a channel-shaped member 33. The band 13 is fed to the channel-shaped member 33 from any conventional coil or the like (not shown). Since the band 13 is held tightly between the circumference of the feed roll 32 and the bottom of channel 33, a predetermined exact amount of band 13 can be fed by roller 32 depending upon the extent of rotation or number of revolutions of the roller 32. If the circumference of the roller 32 is, for example, ten inches, then it can be readily determined that for each revolution of the roller 32 ten inches of band will be fed into operative association with the hoop 10.

The roller 32 is driven by a sprocket 35 (see FIG. 4) mounted on the same shaft 36 as the roller 32, and the sprocket in turn is driven by a chain 37 and large drive sprocket 38, the chain 37 moving around the sprockets 35, 38 and being held taut by the conventional spring-pressed idler sprocket 39. The sprocket 38 is mounted on a shaft 40 parallel to the shaft 36, and a conventional one-way clutch 39' (see FIG. 5) associated with the shaft 40 and the sprocket 38 allows rotation of the sprocket 38 only in the clockwise direction D (see FIG. 4).

The mechanism for effecting rotation of the sprocket 38 a predetermined readily-adjustable amount includes the sprocket 42 mounted on shaft 40, chain 44, piston and cylinder assembly 51, and adjustable position magnetic switch 60.

The chain 44 is attached at one end 45 thereof to the frame, and at the other end 46 thereof to a slide block 47 mounted for sliding linear movement on the rod 48. A spring 49 surrounding rod 48 and acting between the frame and the block 47 biases the block 47 in the direction E (see FIG. 4).

The piston and cylinder assembly 51 includes a piston rod 52 having a chain-engaging roller 53 mounted on the end thereof. The cylinder is dual-acting and is supplied fluid from line 54 to return it to its original position (FIG. 4), or from line 55 to effect movement of the piston rod and the roller 53 in the direction E.

Figure 5:
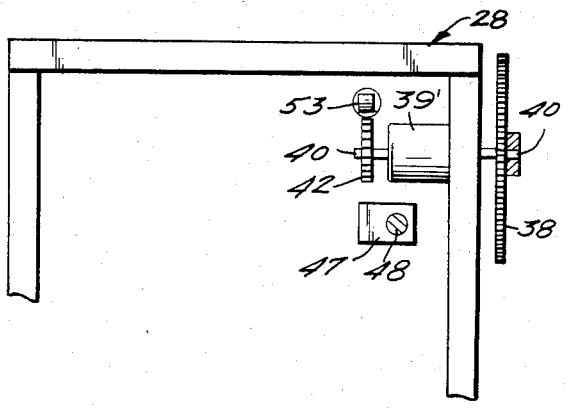
FIG. 5 is an end view of the particular mechanisms of FIG. 4 looking in the direction of arrow B in FIG. 4, and with the chains removed for clarity of illustration.
Figure 6:
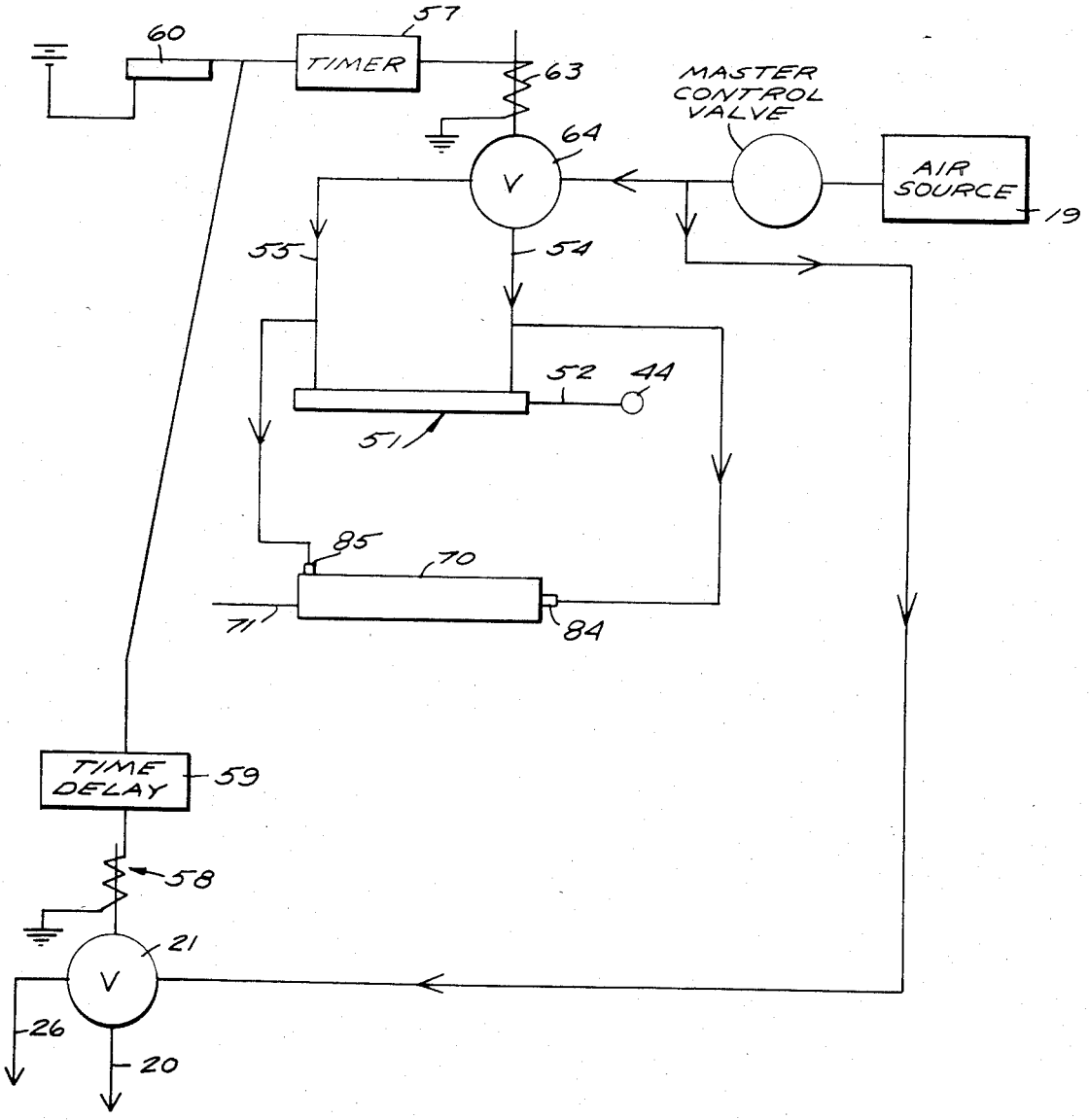
FIG. 6 is a schematic of exemplary pneumatic and electrical controls for the apparatus of FIGS. 1–5; and FIGS. *7a–7f* are side schematic views showing the sequence of operation of the band cutting and feeding mechanism as it moves from the position illustrated in FIG. 1 to the position illustrated in FIG. 2.
Figure 7A:
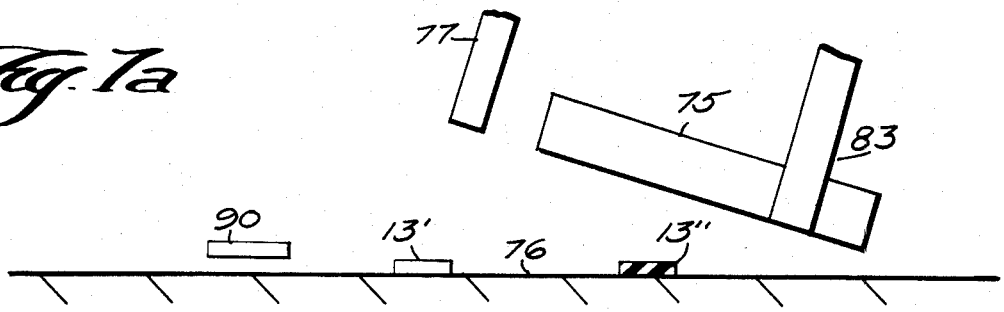
Figure 7B:
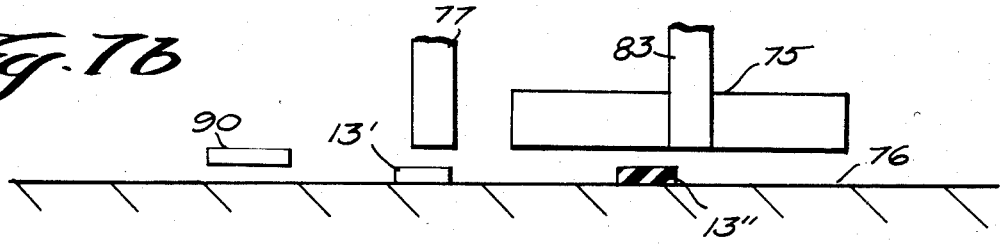
Figure 7C:
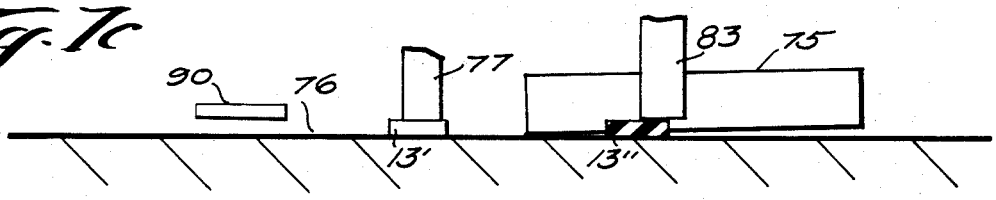
Figure 7D:
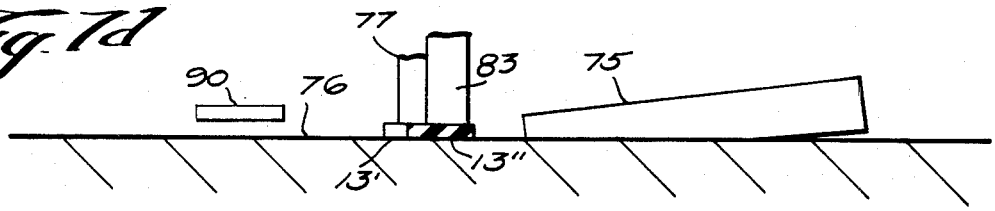
Figure 7E:
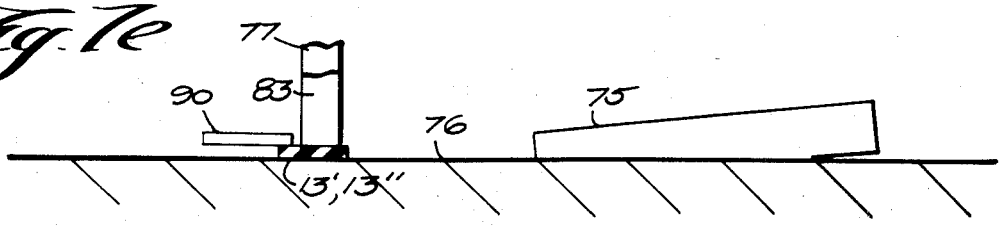
Figure 7F:
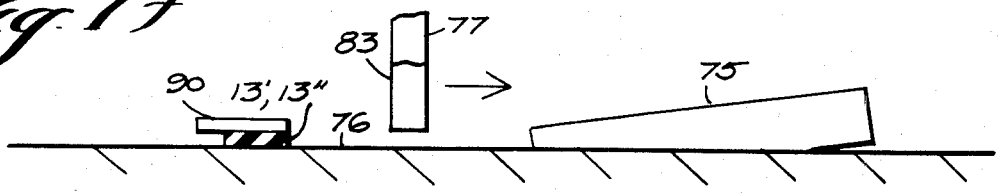

The length of the stroke of the piston rod 52 is readily made precisely adjustable by adjusting the position of the magnetic switch 60, which senses when the piston within the piston and cylinder assembly 51 moves into operative alignment therewith. The magnetic switch 60 controls a timer 57, which in turn controls a solenoid 63 (see FIG. 6), which in turn controls a valve 64 for supplying fluid to the lines 54, 55; and switch 60 may also control solenoid 58 for instantaneously (only) actuating valve 21 through time delay 59 (FIG. 6). The switch 60 is mounted on a threaded rod 61 rotatable by a handle 62, rotation of the handle 62 changing the linear position of the switch 60 along the length of the cylinder assembly 51. The electrical lead lines from the magnetic switch 60 are not shown in FIGS. 1 and 5 for clarity of illustration.

A mechanism for cutting the elastic band 13 to its predetermined length, and automatically feeding the elastic loop when formed to an automatic sewing machine, shown generally by reference numeral 65 (see FIGS. 1 and 2). In FIG. 1 in solid line position, the mechanism 65 is shown in the position allowing feeding of the band 13 by the feed roll 32 into the hoop 10, while the dotted line configuration in FIG. 1—and the illustration in FIG. 2—show the mechanism 65 moved to the cutting and feeding position.

FIGS. *7a–7f* show the relative positions of important components of the mechanism 65 as it is moved from the position illustrated in FIG. 1 to the position illustrated in FIG. 2, FIG. *7f* showing the components as the loop is being sewn and the feeding components are returning to their original position.

The mechanism 65 includes a head 66 mounted for pivotal movement about a horizontal axis indicated by pin 67 in FIG. 1. The head 66 is moved between an upper position, as illustrated in FIG. 1, and the down position, as illustrated in FIG. 2, by a pneumatic piston and cylinder assembly 69, which includes a cylinder 70 and piston rod 71.

The head 66 includes as one component part thereof a cutting blade 75 which severs the band 13 after the desired predetermined length has been fed by feed roller 32. The severing action is triggered by switch 60 in any conventional manner, as illustrated in FIG. 6. As soon as severing occurs, the compressed air from conduit 20 is switched to conduit 26 and thereby blows the elastic loop that has been formed out of the channel 16 in direction C (FIG. 3). The left end of the loop (as viewed in FIG. 2), 13', blown out of the channel 16 is held by feed dog 77 in contact with horizontal support arm 76. The feed dog 77 is mounted for reciprocal movement in dimension G (see FIG. 1) by rod 78. Rod 79 mounts feed dog 83 for movement in dimension G, dog 83 being pivotally connected to the free end of piston rod 71, and dog 83 holds the right end of the loop (as viewed in FIG. 2), 13'', blown out of the channel 16 in contact with arm 76.

Upon actuation of piston and cylinder assembly 69 by feeding air to upper port 84 thereof (see FIGS. 1 and 6), not only is the blade 75 moved into cutting position, but the feed dog 83 is moved along the length of the rod 79 until it catches up with the feed dog 77, at which point they both hold the ends of the formed elastic loop and move the elastic loop into operative association with a conventional automatic sewing machine, only a portion thereof shown in FIG. 1 and identified by reference numeral 90. The sewing machine may be of any conventinal type, such as a Union Special, and automatically effects stitching of the free ends of the elastic loop together. The piston rod 71 returns to its FIG. 1 position when the air is switched from port 84 to port 85 (FIGS. 1 and 6).

The loop, once the free ends 13', 13'' thereof are sewn, is removed from the end 91 of the horizontal support 76. As the loop passes over the free end 91 of support 76 it moves past a hot wire thread cutter, shown schematically by reference numeral 95 in FIG. 1, and a conventional vacuum source 96 can be hooked up to the hot wire thread cutter 95 to remove threads severed thereby.

OPERATION

The operation of the exemplary apparatus heretofore described is as follows:

The free end of an elastic band 13 is fed into the open top 30 of the channel 16 formed by shells 11, 12 of the hoop 10 by the feed roll 32, air being supplied to the jets 23, 24 through valve 21, and causing the elastic band—when introduced into the channel 16—to move over projection 15 and back into the channel, and all the way around the channel to the start, at which point it is stopped by an abutment (not shown). The amount of rotation of the feed roll 32 determines the length of the band 13 fed into the hoop 10, and any length of band 13 desired in excess of the circumference of the channel 16 moves through opening 15 into the center of the hoop 10, as illustrated in FIG. 2. The elastic 13 is not stressed during feeding, so that there is no elastic deformation thereof during feeding.

The length of band to be looped is adjusted by turning handle 62 to thereby adjust the position of the magnetic switch 60 with respect to the piston and cylinder assembly 51. At the start of the feeding operation, air from a central pressure source 19 is supplied through line 55 to the piston and cylinder assembly 51, which causes the chain-engaging roller 53 to move in the direction E, and in turn causes the chain 44 to effect rotation of the sprocket 42, and shaft 40 attached thereto. This in turn effects rotation of the large sprocket 38, and the sprocket 35 which is mounted to the same shaft 36 as the roller 32. When the piston of the piston and cylinder assembly 51 moves into operative alignment with the switch 60, air in line 55 is automatically cut off and the air is instead supplied to piston and cylinder assembly 51 by line 54. This thus immediately stops rotation of the rollers 32, and also automatically actuates cylinder 70 (see FIG. 6) so that the head 66 is pivoted downwardly about pin 67.

Figure 4:
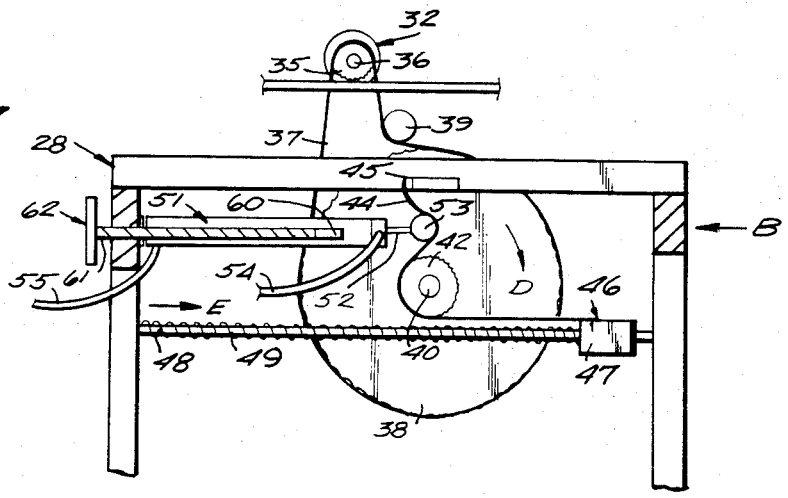
FIG. 4 is a side view, partly in cross-section and partly in elevation, taken generally at 4—4 in FIG. 1, and showing the loop length control mechanism of the apparatus of FIGS. 1 and 2 in detail.

Spring 49 causes automatic return of the components illustrated in FIG. 4 to the position illustrated in FIG. 4, one-way clutch 39 preventing return rotation of the sprocket 38. Soon after the air is supplied to conduit 54, and the elastic band is cut, the valve 21 is activated to switch air from tube 20 to tube 26, and ultimately to header 27, providing an air blast blowing the elastic loop that has been formed out of the channel 16 and onto the horizontal support 76 into operative association with the feed dogs 77, 83.

The synchronized downward pivoting (see FIGS. *7a–7f*) of the head 66 causes the blade 75 to cut the elastic, and simultaneously the piston rod 71 moves the feed dogs 77 83 into engagement with an end of the elastic (see FIG. *7c*). The feed dogs 77, 83 are powered by the piston and cylinder assembly 69 until they bring the ends 13', 13'' of the elastic loop that has been formed into operative association with the automatic sewing machine 90 (see FIG. *7e*) whereby they are stitched, pulled off the support 92 over the thread cutter 95, and then used to form a desired garment.

Once the feed dogs 77, 83 have reached their limit of travel (see FIG. *7e*), the valve 64 actuation is automatically terminated and it moves back to its normal position supplying air to passageway 55 and port 85—which moves the head 66 about its pivot 67 back toward (see FIG. *7f*) its original position illustrated in FIG. 1, this pivoting movement automatically causing the feed dog 77 to move along guide rod 78 back to its original position.

The electrical and pneumatic circuitry illustrated in FIG. 6 is modified as necessary to provide the desired sequence of operation of the components.

Thus it will be seen that according to the present invention a method and apparatus for the quick and efficient formation of elastic loops of a wide variety of sizes have been provided.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method for forming an elastic band loop of any desired circumference, utilizing an annular channel having a fixed circumference and an overfeed opening; comprising the steps of:

(a) automatically feeding a predetermined length of an elastic band, at least as great as the circumference of the channel, into the channel from a supply of elastic band, with any length of band in excess of the channel circumference traveling into the overfeed opening, the length of band being fed being determined independent of the channel circumference;

(b) automatically severing the band from the supply once the predetermined length thereof has been fed into the channel, to provide an elastic loop with a pair of adjacent free ends;

(c) automatically removing the predetermined length band loop from the channel; and (d) automatically effecting closing of the loop by affixing the free ends thereof together.

2. A method as recited in claim 1 wherein steps (a) through (d) are practiced without significant elastic deformation of the band.

3. A method as recited in claim 1 wherein step (a) is accomplished by mechanical and pneumatic means.

4. A method as recited in claim 3 comprising the further step of between steps (a) and (b) pneumatically blowing the formed loop out of the channel in an axial direction with respect to the channel.

5. A method as recited in claim 3 wherein step (a) is accomplished by directing a flow of air onto the elastic band adjacent the overfeed opening to prevent the band free end from entering the overfeed opening, but allowing any length of band in excess of the channel circumference to overfeed into the overfeed opening.

6. A method as recited in claim 1 comprising the further step of quickly adjusting the predetermined length of the elastic band loop to be formed without adjustment to, or changing, of the fixed circumference annular channel.

7. Apparatus for feeding a predetermined length of material to a structure for acting on the material, said feeding means comprising:

a feed roller rotatable with a first shaft;

a surface cooperating with said feed roller, with the material fed by said feed roller between the circumference thereof and said surface;

means for rotating said first shaft through a predetermined arcuate path or a number of revolutions, comprising: a piston and cylinder assembly including a piston rod having a strip-engaging surface formed with the free end thereof; a flexible strip of fixed length, said strip fixed at a first end thereof and connected to a slideable block at the send end thereof, a spring for biasing said slideable block in a first direction; a driven rotatable component rotatable about a shaft, said driven rotatable component in operative engagement with said strip so that upon linear movement of said piston rod said strip effects linear movement of said block and rotatable movement of said rotatable driven component; and a one way clutch means operatively acting between said rotatable driven component and said feed roller so that said feed roller is rotatable only in one direction; and condition-responsive means for sensing the extend of movement of said piston rod, and terminating further movement of said piston rod when the predetermined length of material has been fed by said feed roller.

8. Apparatus as recited in claim 7 wherein said condition-responsive means comprises a magnetic switch mounted in operative association with said piston and cylinder assembly to sense the position of the piston of said piston and cylinder assembly.

9. Apparatus as recited in claim 8 further comprising means for adjusting the position of said magnetic switch with respect to said piston and cylinder assembly.

10. Apparatus as recited in claim 9 wherein said adjustment means comprises an exteriorly threaded rod onto which said magnetic switch is mounted, and a stationary interiorily threaded support cooperating with said threaded rod so that rotation of said threaded rod effects linear movement of said magnetic switch with respect to said piston and cylinder assembly.

11. Apparatus as recited in claim 7 wherein said shaft about which said rotatable component is rotatable is a second shaft, spaced from, and parallel to, said first shaft, and further comprising means for transmitting force effecting rotation of said second shaft to said first shaft for effecting rotation thereof.

12. Apparatus as recited in claim 11 wherein said means for effecting rotation of said first shaft in response to rotation of said second shaft comprises a second rotatable component mounted to, and rotatable with, said second shaft, a third rotatable component mounted to, and rotatable with, said first shaft; and means for providing operative interengagement between said second and third rotatable components.

13. Apparatus as recited in claim 12 wherein said rotatable component, second rotatable component, and third rotatable component comprise first, second, and third sprockets, respectively; and wherein said strip comprises a chain operatively engaging said first sprocket; and wherein said means for providing operative interengagement comprises a chain operatively extending between said second and third sprockets.

14. Apparatus as recited in claim 13 wherein said one way clutch means comprises a one way clutch acting between said first and second sprockets; and wherein said second sprocket is substantially larger than either said first or third sprockets.

15. Apparatus for facilitating formation of elastic loops of a predetermined length, comprising;

means defining an annular channel of a fixed circumference, said means including inner and outer concentric tubular shells;

means defining a radial, axially extending, overfeed opening in one of said shells to allow overfeed of elastic from said channel through said opening; and means for feeding elastic material into, and through the entire circumference of, said annular channel.

16. Apparatus as recited in claim 15 wherein said feeding means include pneumatic means for directing a jet of air in a predetermined direction through said channel.

17. Apparatus as recited in claim 16 wherein said feeding means further comprises means for directing a jet of air adjacent said overfeed opening for preventing a free end of elastic from moving through said overfeed opening while allowing overfeed if elastic through said opening.

18. Apparatus as recited in claim 17 further comprising a radially inwardly extending ramp formed on said outer tubular shell adjacent said overfeed opening for facilitating overfeed of elastic into said overfeed opening.

19. Apparatus as recited in claim 15 further comprising means for ejecting an elastic loop disposed in said annular channel from said channel, said ejecting means comprising means for axially directing a blast of air into said annular channel at one end thereof.

20. Apparatus as recited in claim 18 further comprising means for ejecting an elastic loop disposed in said annular channel from said channel, said ejecting means comprising means for axially directing a blast of air into said annular channel at one end thereof.

21. Apparatus as recited in claim 20 further comprising valve means for valving the flow of air either to said means for axially directing a blast of air into said channel, or to said air jets for facilitating movement of elastic through said channel.

22. Apparatus for forming an elastic loop of predetermined length comprising: means defining an annular channel of a fixed circumference;

means for feeding an elastic band of a predetermined length into said annular channel, said elastic band predetermined length being independent of the fixed circumference of said annular channel;

means for automatically severing said elastic band when the predetermined length thereof inside said channel has been reached;

means for automatically moving the elastic band loop of predetermined length formed in said annular channel axially out of said annular channel; and means for affixing together the ends of the elastic loop of predetermined length when moved out of said annular channel.

23. Apparatus as recited in claim 22 wherein said means for moving said elastic loop of predetermined length out of said annular channel into said means for affixing the ends thereof together comprises: means for directing an axial blast of air into said annular channel; a horizontal support extending axially with respect to said annular channel, and interior thereof; and at least one feed dog for cooperating with said horizontal support for moving said elastic loop along said support to said affixing means.

24. Apparatus as recited in claim 23 wherein said annular channel has a horizontally extending axis; and wherein said means for severing the elastic and said at least one feed dog are mounted on a head pivotable about a horizontal axis perpendicular to said annular channel horizontal axis, and disposed above said annular channel horizontal axis.

25. Apparatus as recited in claim 24 wherein said means for feeding elastic bands to said annular channel comprises: a feed roller rotatable with a first shaft;

a surface cooperating with said feed roller, with the material fed by said feed roller between the circumference thereof and said surface;

means for rotating said first shaft through a predetermined arcuate path or a number of revolutions, comprising: a piston and cylinder assembly including a piston rod having a strip-engaging surface formed with the free end thereof; a flexible strip of fixed length, said strip fixed at a first end thereof and connected to a slideable block at the second end thereof a spring for biasing said slideable block in a first direction; a driven rotatable component rotatable about a shaft, said driven rotatable component in operative engagement with said strip so that upon linear movement of said piston rod said strip effects linear movement of said block and rotatable movement of said rotatable driven component; and a one way clutch means operatively acting between said rotatable driven component and said fee roller so that said feed roller is rotatable only in one direction; and condition-responsive means for sensing the extent of movement of said piston rod, and terminating further movement of said piston rod when the predetermined length of material has been fed by said feed roller.

26. Apparatus recited in claim 25 wherein said annular channel is defined by inner and outer concentric tubular shells; and further comprising means defining a radial, axially extending, overfeed opening in said inner shell; and wherein said means for feeding the elastic band in said annular channel includes a plurality of air jets for directing a flow of air in said annular channel.

* * * * *